US007914471B2

(12) United States Patent
Chen

(10) Patent No.: US 7,914,471 B2
(45) Date of Patent: Mar. 29, 2011

(54) SHOULDER MASSAGE CHAIR

(76) Inventor: Samuel Chen, Hunghom Kowloon (HK)

( * ) Notice: Subject to any disclaimer, the term of this patent is extended or adjusted under 35 U.S.C. 154(b) by 871 days.

(21) Appl. No.: 11/805,022

(22) Filed: May 22, 2007

(65) Prior Publication Data

US 2008/0167588 A1 Jul. 10, 2008

Related U.S. Application Data

(63) Continuation-in-part of application No. 11/651,860, filed on Jan. 10, 2007, now Pat. No. 7,713,220.

(51) Int. Cl.
*A61H 15/00* (2006.01)

(52) U.S. Cl. ..... 601/99; 601/98; 601/101; 297/284.9

(58) Field of Classification Search ..... 601/23, 601/24, 49, 86, 87, 90, 98, 99, 100, 101, 601/102, 103, 115, 146, 148; 297/284.9, 297/219.1, 219.11, 223, 230.1
See application file for complete search history.

(56) References Cited

U.S. PATENT DOCUMENTS

| | | | | |
|---|---|---|---|---|
| 3,675,644 | A * | 7/1972 | Laskowitz | 601/115 |
| 5,868,687 | A * | 2/1999 | Tedesco | 601/49 |
| 2004/0127822 | A1* | 7/2004 | Eisenberg | 601/49 |
| 2005/0131320 | A1* | 6/2005 | Lee | 601/119 |

* cited by examiner

*Primary Examiner* — Quang D Thanh
(74) *Attorney, Agent, or Firm* — Clement Cheng

(57) ABSTRACT

A multiple mode massage chair is provided for being interchangeably used as a seating support and a massaging platform. Above the conventional components of an advanced chair construction such as a horizontal base with a number of casters for slidably supporting the base over the floor, an upholstered seat bottom and seatback assembled to the base through a telescopic upright stand for a height adjustment from the base, the invention provides pairs of elongated cushion flaps pivotally attached to the seat bottom and seatback for selectively providing an extra cushion to the seated user on the respective seating surfaces. Each flap is shaped to flap on a bi-level pivot action to cover or expose an underlying massage surface of the chair with the assistance of a toggle action in order to facilitate the change of the mode of operation of the chair.

17 Claims, 6 Drawing Sheets

SHOULDER MASSAGE CHAIR

This application is a continuation in part of and claims priority from inventor Samuel Chen's U.S. patent application Ser. No. 11/651,860 Multiple Mode Massage Chair filed Jan. 10, 2007,now U.S. Pat. No. 7,713,220 the entire disclosure of which is incorporated herein by reference.

BACKGROUND OF THE INVENTION

A. Field of the Invention

The present invention relates to massage furniture. More particularly, the present invention relates to a chair with two interchangeable modes of operation between an ergonomic seat and a massaging platform.

B. Discussion of Related Art

Chairs are structured to support human body in motion or at rest comfortably and their detailed designs are classified to fit various seating environments like an office for work, an automobile for travel or a lounge. On top of the ordinary seating functions, chairs began to employ electric massaging devices in and around the seat backs and/or bottoms of the chairs to revitalize men and women from long hours of hard work. Such devices may be installed inside the chair structure or separately retrofitted thereto. Internal massage units may have a frame for movably supporting massage rollers or nodes powered by motors through a transmission mechanism under a programmed control to perform a kneading massage, acupressure or rolling massage on the posterior side of the occupant. One of the practical massage chair structures is found in U.S. Pat. No. 6,629,939 the disclosure of which is incorporated herein by reference. An exemplary portable body massager is disclosed in U.S. Pat. No. 7,128,721 the disclosure of which is incorporated herein by reference.

To deliver the effective massage pressures, the massaging interface of the massage unit is normally lightly padded or simply visually blocked. Normally the massaging interface presses against the occupant's body areas of spine, lumbar, buttocks and pelvic bones by his or her weight. Before and after the relatively short massaging sessions the chair also needs to provide a good cushioning function via a certain amount of upholstery. A user may solve the problem by adding a small pillow or by draping a towel over the massaging interface of the chair massager or portable massager so that the user may change the surface of the seating area every time the chair switches between the massaging mode and the supporting mode. This is awkward though.

Finally, users have a need for a chair that can look like an ordinary office chair when not being used for massage. If user uses a massage chair such as those seen in the prior art as an everyday office chair, it may be inappropriate in certain social situations such as conferences or meetings.

It is therefore, an object of the present invention to provide a set of integrated cushion members to convert the massage unit interface of the massage chair from a massager mode to a seating mode and vice versa without using unsightly or unbalancing accessories to the chair.

Another object of the invention is to provide two distinctive chair modes of bodily support and therapeutic massager based on a single compact chair.

Yet another object of the present invention is to provide a simple chair conversion means for reconditioning the chair cushion between its seating mode and massager mode whether the massager is an onboard type or portable device mounted on the chair.

SUMMARY OF THE INVENTION

To provide the dual mode of operation in a single seat, the present invention has a user-configurable cushion preferably fabric joined for flip open mechanical connection to chair upholstery.

A two-mode massage chair of the present invention generally comprises a horizontal base supporting the entire chair on a number of casters, a seat bottom attached to the base through an upright stand, a couple of arm rests and a contoured seatback both supported by the stand. On top of the chair is a headrest, which may be a separate member mounted to the chair or an extension of a top central portion of the seatback to support the occupant's head.

The chair also has at its side edges a front surface with two opposing protrusions or bolsters provided for cradling the sides of the occupant's back torso. The bolsters may be separately covered by the fabric, leather or similar material as used for the front seating surface and may be stitched to the same surface along contoured indentations.

Over the bolsters there are provided pea pod shaped flaps each being held along a section of the indentation between the seatback portions in a toggle-action mechanism. Either flap is shaped in the mirror image of the other and upholstered using the same material so that the opposite faces of a single flap may be consistent and a single design commonly makes up either side flap to keep the manufacturing of the chair economical. In this embodiment, the flap is filled with a padding to provide a cushion to compensate the lack of softness of the front seating surface, which should permit thrusts of the massaging head of the unit delivered to the occupant with less dampening.

In addition, the flap has a proximal side generally divided into a first lump spanning about top one third of the length of the flap, a second lump at a bottom one third of the length of the flap and a middle recess that connect the two lumps. The flap has a slightly arched distal side so that when both side flaps are flipped open the distal sides approximately coincide with the corresponding side edges of the seatback while the distal sides faces each other in a close proximity or meet together along a longitudinal centerline of the seatback.

The main area of the flap is generally shaped like an oversized pea pod to support approximately a half side area of the occupant's posterior including the torso and lower back. Depending on the specific chair design, the top protrusion is optional and the flap may be shaped to have a plain top in case the headrest of the chair is omitted or free of a massaging source.

In operation of the flap on the chair surface, the lumps become pushed aside whenever the occupant moves the flap to either side for a change of the chair mode providing a toggle-flip action. Because either side pivot is virtually positioned at a location beyond the anchor pivot into a depth of the seatback the flap is forced to lie flat on the seatback whenever the user pulls the flap and deflect it the opposite side overcoming the resistance of the lumps against the front seating surface.

The bottom flaps for the seat bottom may be made and installed in the method described above for the flap to provide the similar functions to the lower seating areas of the occupant.

In a second embodiment of the invention the chair has three sets of flap pairs for independent manipulations by hands to toggle between the respective inside and outside of the massaging regions of the chair.

Flip down shoulder massage elements can have roller elements that move on a slot toward and away from the shoulder while providing a massage. The roller elements optionally include vibration elements to provide alternate vibration and rolling massage. The roller elements can be replaced by airbags to provide an airbag massaging embodiment. Embodiments of the invention will now be described by way of example with reference to the accompanying drawings.

DETAILED DESCRIPTION OF THE PREFERRED EMBODIMENT

Figure 1:
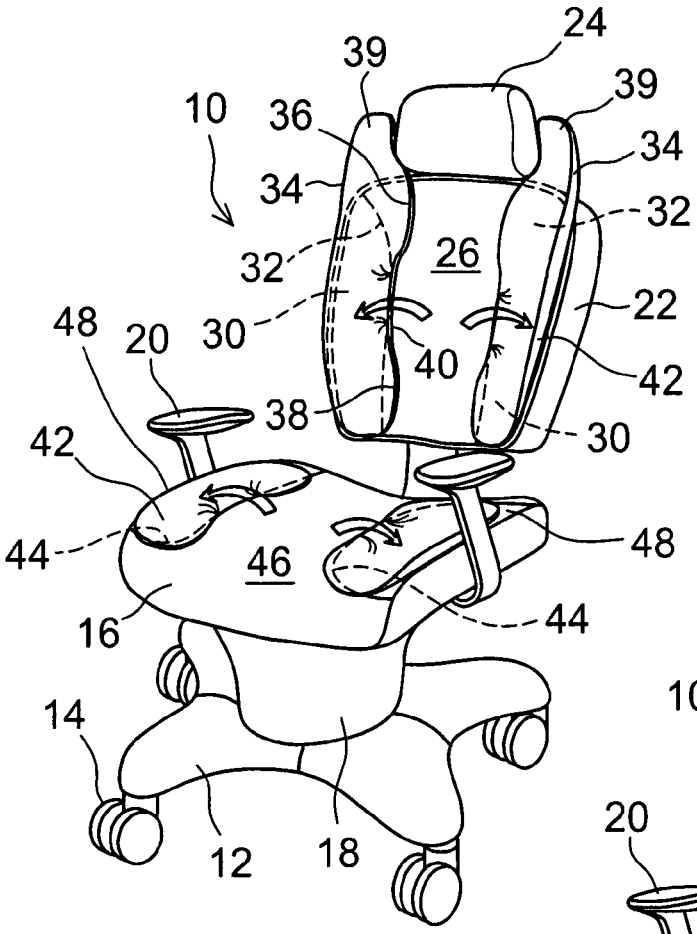
FIG. 1 is a perspective view of a two-mode massage chair in a massager mode according to a first embodiment of the present invention.

With reference to FIG. 1, a two-mode massage chair of the present invention is generally designated by 10 and comprises a horizontal base 12 supporting the entire chair 10 on a number of casters 14, a seat bottom 16 attached to the base 12 through a telescopic upright stand 18 for a height adjustment from the base 12, the seat bottom a couple of arm rests 20 and a contoured seatback 22 both supported by the stand 18. On top of the chair 10 is a headrest 24, which may be a separate member mounted to the chair 10 or an extension of a top central portion of the seatback 22 to support the occupant's head.

The overall seating surfaces of the chair 10 may be conventionally upholstered. Specifically, the seatback 22 has a front seating surface 26 of a fabric, leather or similar material that thinly covers an electrical massaging unit 28 installed in the cavity of the seatback 22 as shown schematically in FIG. 3. At side edges of the front surface 24 two opposing protrusions or bolsters 30 are provided for cradling the sides of the occupant's back torso. The bolsters 30 may be separately covered by the fabric, leather or similar material as used for the front seating surface 26 and may be stitched to the same surface 26 along contoured indentations 32.

Over the bolsters 30 there are provided pea pod shaped flaps 34 each being held along a section of the indentation 32 between the seatback portions 26 and 30 in a toggle-action mechanism as will be further detailed below. Either flap 34 is shaped in the mirror image of the other and upholstered using the same material so that the opposite faces of a single flap 34 may be consistent and a single design commonly makes up either side flap 34 to keep the manufacturing of the chair 10 economical. In this embodiment, the flap 34 is filled with a padding to provide a cushion to compensate for the lack of softness of the front seating surface 26. The flap covers the massaging head of the unit 28. The exact mechanical configuration for the massaging units is well known in the art and has been discussed in a wide variety of patents. The preferred massaging unit is the standard rotating roller head that is commonly and commercially available in many units currently on the market. Any number of roller head units can be used. The mechanical configuration can be configured according to customers needs.

Figure 2:
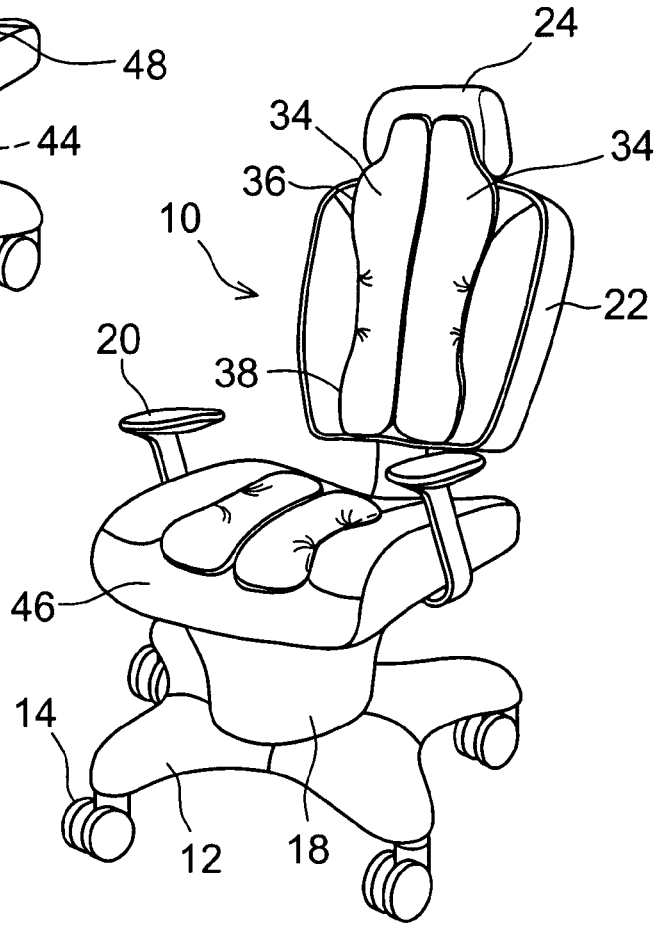
FIG. 2 is a perspective view of the two-mode massage chair of FIG. 1 in a seating mode.

In addition, the flap 34 has a proximal side generally divided into a first lump 36 spanning about top one third of the length of the flap 34, a second lump 38 at a bottom one third of the length of the flap 34 and a middle recess 40 that connect the two lumps 36, 38. The flap 34 has a slightly arched distal side 42 so that when both side flaps 34 are flipped open the distal sides 42 approximately coincide with the corresponding side edges of the seatback 22 as shown in FIG. 1 while the distal sides 42 faces each other in a close proximity or meet together along a longitudinal center line of the seatback 22 as shown in FIG. 2. Note that FIG. 2 depicts the same chair 10 as in FIG. 1 with its configuration changed into the seating mode of operation.

In case the headrest 24 also provides massaging extended to the user's head, the flap 34 may also have a top protrusion 39 that is shaped to conform to the lateral contour of the headrest 24 when the flap 34 is positioned at rest as in FIG. 1 illustrating the massaging mode of operation. To the contrary, when the chair 10 returns to the seating mode where the additional cushion is created by the two flaps 34 flip closed, the top protrusions 39 of the flaps 34 follow suit to cushion an effective head support area of the headrest 24 as in FIG. 2.

Similarly, the seat bottom 16 may have two independent bottom seat flaps 42, which are pivotally attached to indentations 44 between a bottom seating surface 46 in the center of the seat bottom 16 and two lateral bottom bolsters 48 formed integral to the seat bottom 16. Bottom seat flaps 42 also flip open and closed.

Figure 3:
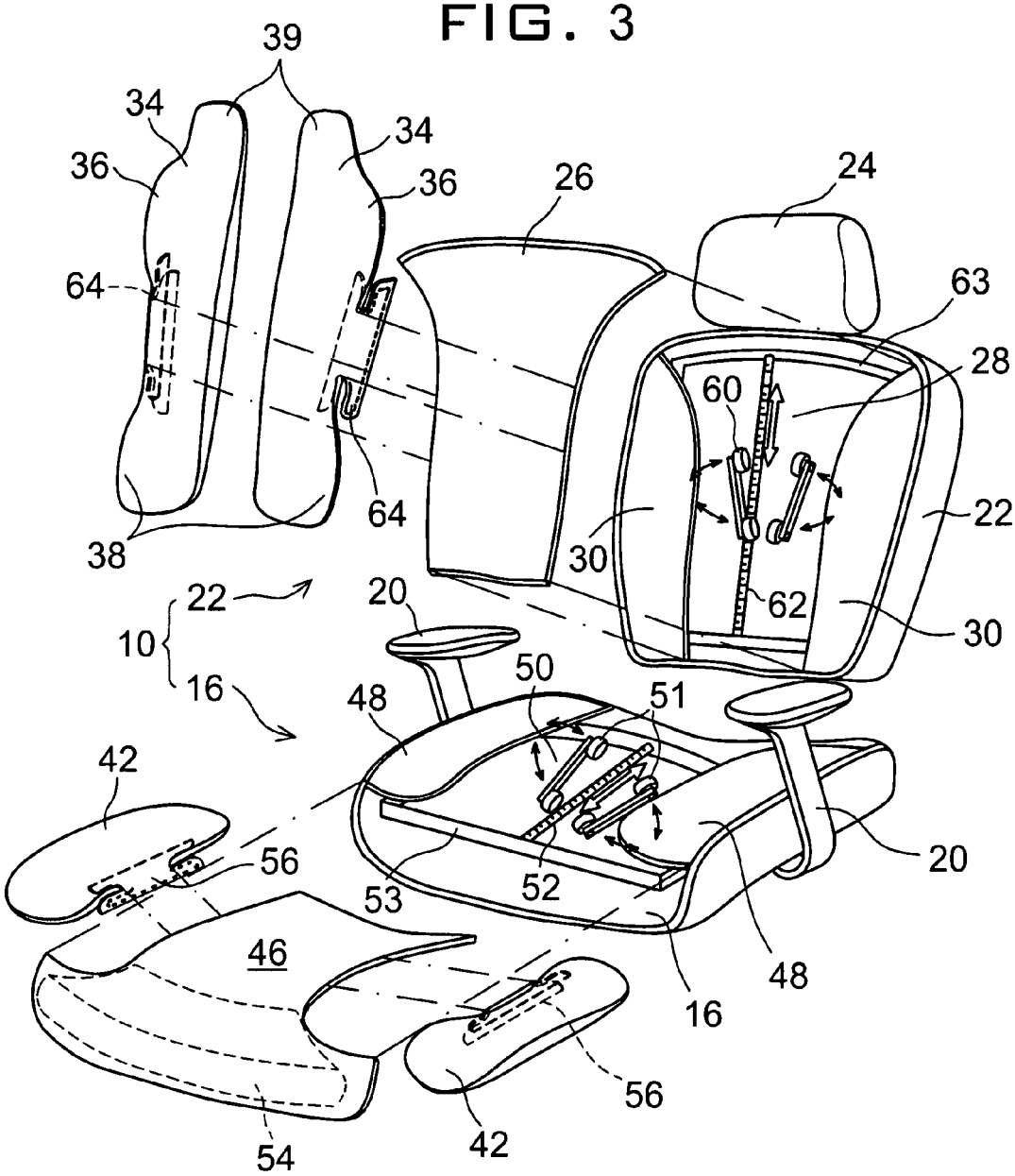
FIG. 3 is an exploded perspective view of the massage chair of FIG.1 showing the primary subassemblies with the supporting base omitted.

FIG. 3 is a partial exploded view of the main components of the bimodal massage chair 10 comprising at its seat base the seat bottom 16 caging a framed massage unit 50 having vibrating pressure rollers 51 traveling along a track 52 in a frame 53 by a motor and transmission mechanism not shown and two padded bottom bolsters 48, the bottom seating surface 46 which may be cushioned by an internal foam block 54, the two padded bottom flaps 42 each having a flexible hinge 56 with a reinforcement for pivotally attaching the flap 42 to the junction between the seating surface 46 and two bolsters 48, and a pair of armrests 20 attached to both sides of the seat bottom 16.

The chair 10 comprises at its backrest area the seatback 22 enclosing a back massage unit 58 with vibrating rollers 60 raised or descended along a track 62 in a fame 63 by a motor and transmission device not shown and two side bolsters 30 padded with foam blocks shaped to fit the covering at 30 of leather, fabric or vinyl, the front seating surface 26 to cover the cavity of the seatback 22 between the bolsters 30, the two padded side flaps 34 each having a flexible hinge 64 with a reinforcement for pivotally attaching the flap 34 to the junction at mid-level between the seating surface 26 and two bolsters 30, and a top headrest 24 that may be movably attached for a height adjustment to the individual occupant's head.

Figure 4:
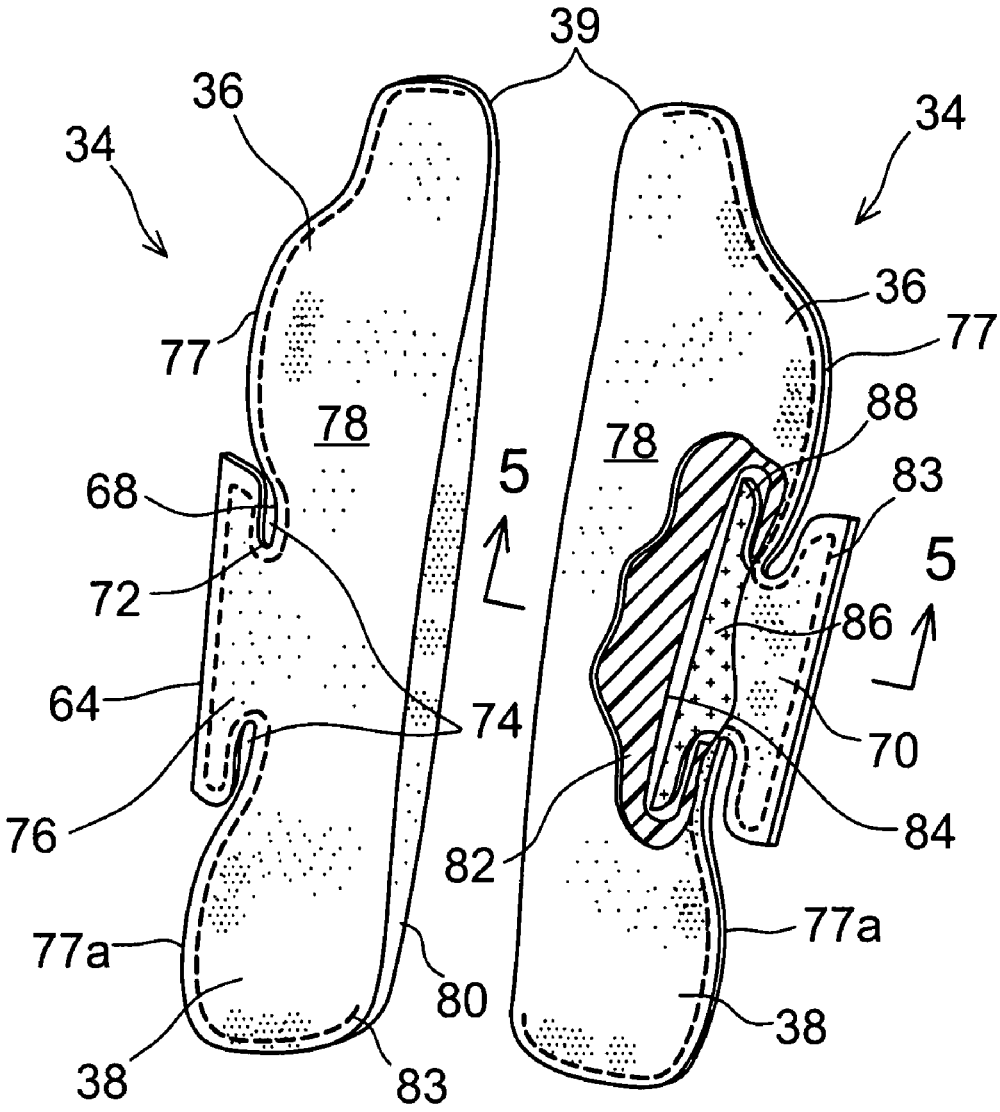
FIG. 4 is a detailed perspective view of the auxiliary toggle bolsters of FIG. 3 with a partial cut away view of the interior of the bolster.

Referring to FIG. 4, a possible construction and function of the cushion flaps 34 will be described. The main area of the flap 34 is generally shaped like an oversized pea pod to support approximately a half side area of the occupant's posterior including the torso and lower back. Depending on the specific chair design, the top protrusion 39 is optional and the flap 34 may be shaped to have a plain top in case the headrest of the chair is omitted or free of a massaging source.

Between the first and second lumps 36, 38 there is positioned a deep recess 68 of the flap 34 from which the integral hinge 64 extends with a neck portion 72 defined by a clearance 74 between the hinge 64 and the main flap area. The hinge 64 provides an anchor pivot 76 once the hinge 64 is fastened with the neck portion 72 tied down under the front seating surface 26 in the assembly of the chair 10 shown in FIG. 3. Similarly, the peak of the lumps 36, 38 provide side pivots 77 and 77*a* about which the flap 34 swivels in two opposite directions.

For each flap 34, two identical sheet sections in a symmetrical shape may provide its exterior surfaces 78. The flap sheet may be folded along its center at a flat elongated area 80 over a foam core 82, which is generally shaped into the main body of the flap 34 providing the desired cushion effect. The sheet sections may be glued and sewn together along a stitch line 83.

In operation of the flap 34 on the chair surface 26, the lumps 36, 38 are pushed aside whenever the flap 34 changes side and mode thereby providing a toggle-flip action. Because either side pivot 77 or 77*a* is virtually positioned at a location beyond the anchor pivot 76 into a depth of the seatback 22 the flap 34 is forced to lie flat on the seatback 22 whenever the user pulls the flap 34 and deflects it to the opposite side overcoming the resistance of the lumps 36, 38 against the front seating surface 26. This built-in toggle action through the bi-level pivot saves an extra fastening means to hold the flap 34 in a stable posture in either mode of the chair operation. Alternatively, a fastening means such as opposing hook and loop tape can hold the flap 34 open and closed.

Figure 5:
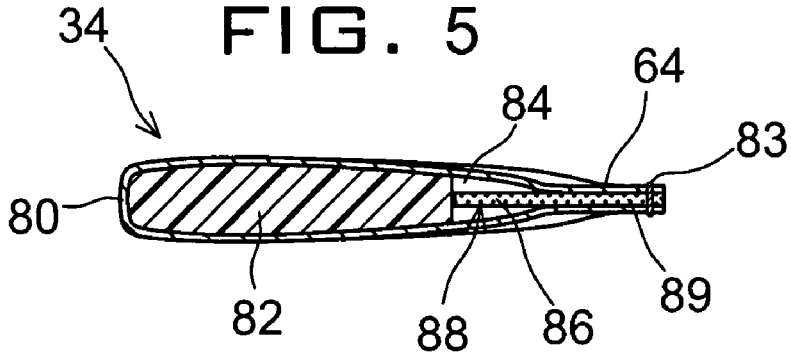
FIG. 5 is a cross sectional view of one of the toggle bolsters taken along line 5-5 of FIG. 4.

Further referring to FIG. 5, the foam core 82 and thus the surface of the flap 34 may have any desired topography to comfortably cushion the posterior of the occupant. In the simplified embodiment as illustrated, middle of the flap 34 near the distal edge at the area 80 has a predetermined thickness as it becomes gradually thinner toward the remaining edges including the opposite proximal edge at the hinge 64 as well as the top protrusion 39. The foam core 82 may be terminated short of the neck portion 72 of the hinge 64 and cut out to have a large slot or bay 84 for receiving a reinforcement member 86. The member 86 may be an elastic plate in the shape of H with a leg 88 held in the bay 84 of the foam core 82 while the other leg 89 extends into the cavity of the sheet area at the hinge 64 thereby making the hinge 64 flexible but durable over the expected life of the chair 10. Alternatively, the foam core 82 may extend into the hinge area to replace the extra reinforcement member 86.

The bottom flaps 42 for the seat bottom 16 may be made and installed in the method described above for the back flap 34 to provide similar functions to the lower seating areas of the occupant.

Figure 6:
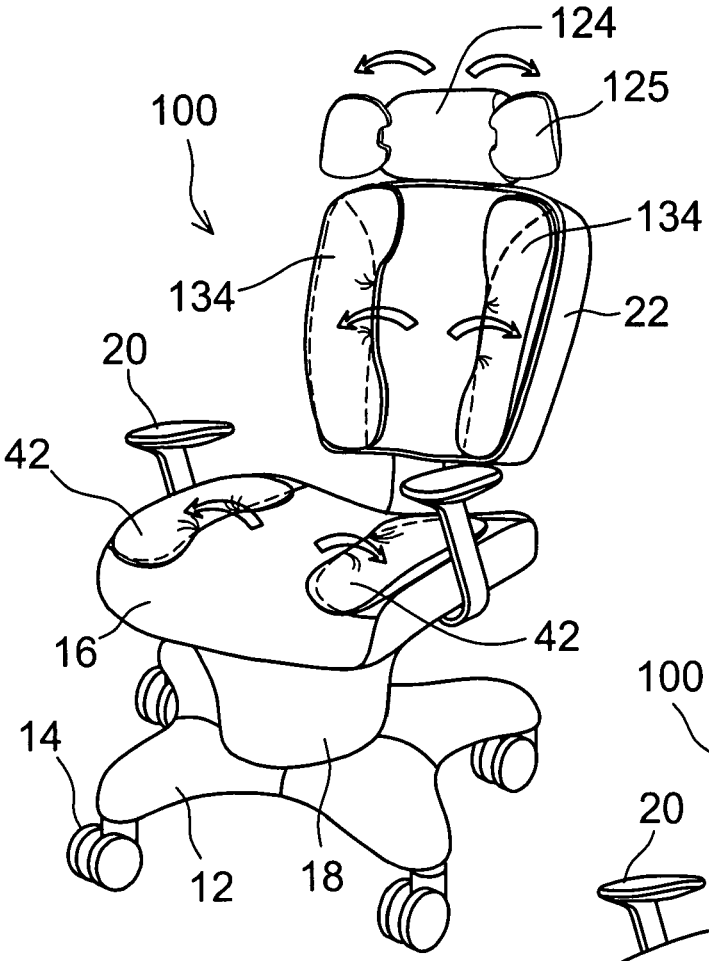
FIG. 6 is a perspective view of a two-mode massage chair in a massager mode according to a second embodiment of the present invention.
Figure 7:
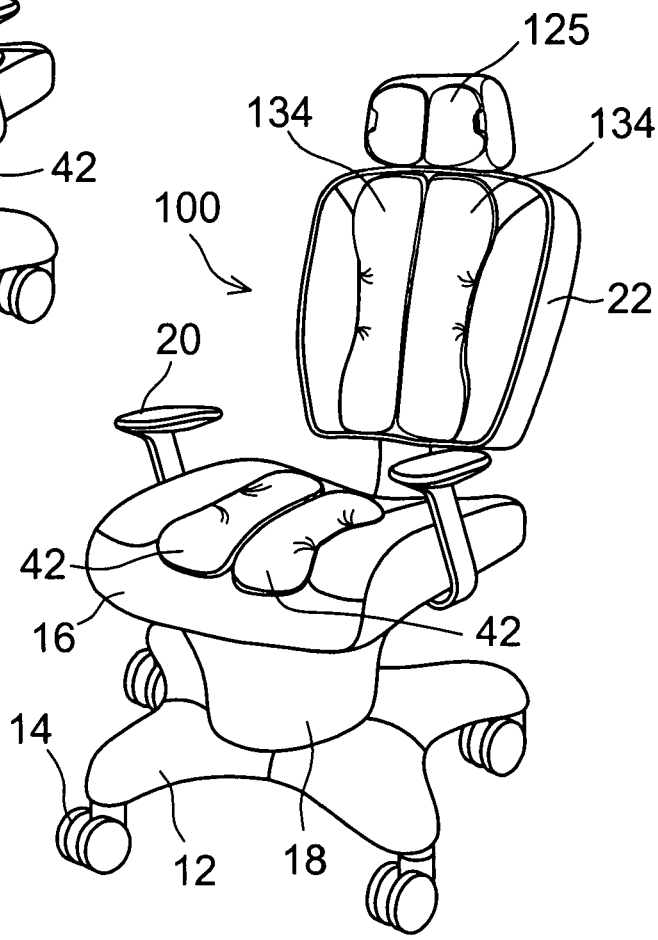
FIG. 7 is a perspective view of the two-mode massage chair of FIG. 6 in a seating mode. Similar reference numbers denote corresponding features throughout the attached drawings.

Referring to FIGS. 6 and 7 of a second embodiment where a chair 100 has three independent parts with massaging as well as seating functions, the operation of the invention will be described. The corresponding portions of the chair 100 to the chair 10 are designated with the same reference numbers. The chair 100 is provided with a massaging headrest 124 exclusively having two side flaps 125, the detailed structure of which is principally same as the flap 34 in FIG. 4 in the first embodiment except the outer profile that conforms to approximately half the front area of the headrest 124. A seatback 122 has two side flaps 134 shaped correspondingly within the periphery of the seatback 122.

In operation, three sets of flap pairs 125, 134, 42 may be independently manipulated by hands to toggle between the respective inside and outside of the massaging regions.

The dynamically cushioned chair of the present invention is also adaptable to work with a portable massage pad that extends at least part of the seating surface of the chair. As with the on-board type of massage unit, the flap pairs may be toggled onto and away from the stimulating surfaces of the massager to provide a swift change between the massage mode and the comfortable support mode over the single chair.

Figure 9:
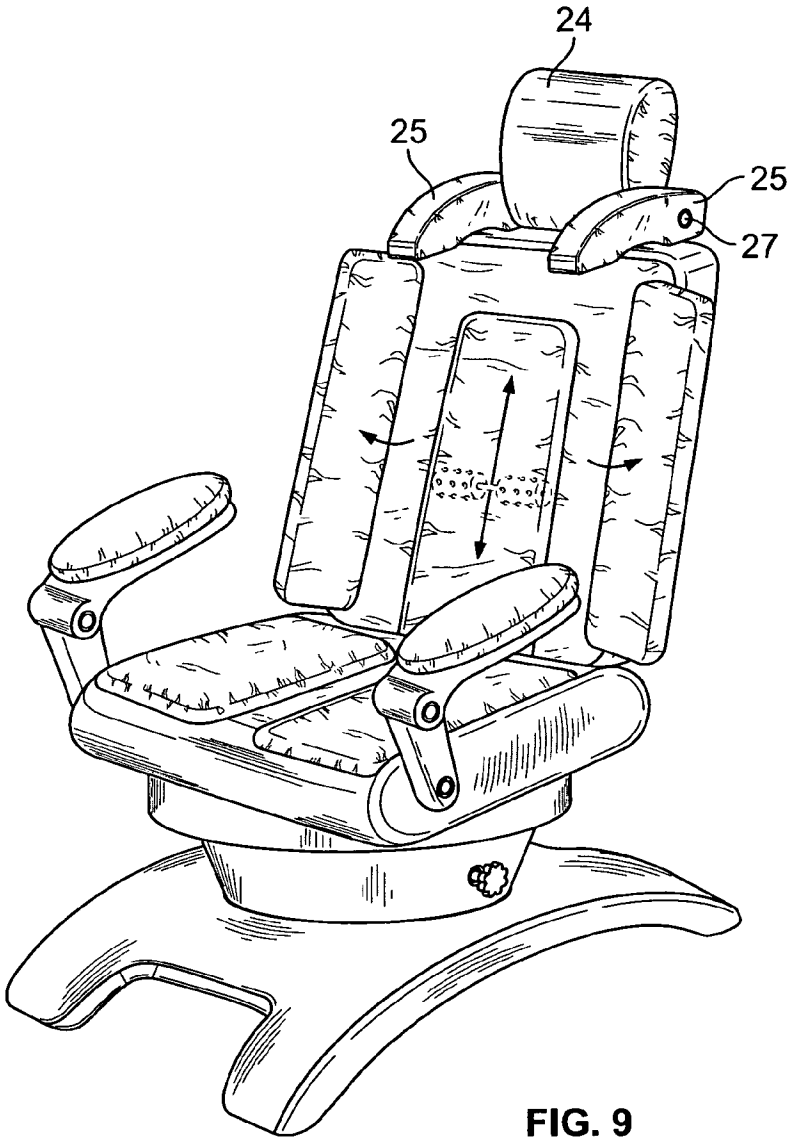
FIG. 9 is a perspective view of a multiple mode massage chair with shoulder massage elements in a massaging mode.
Figure 8:
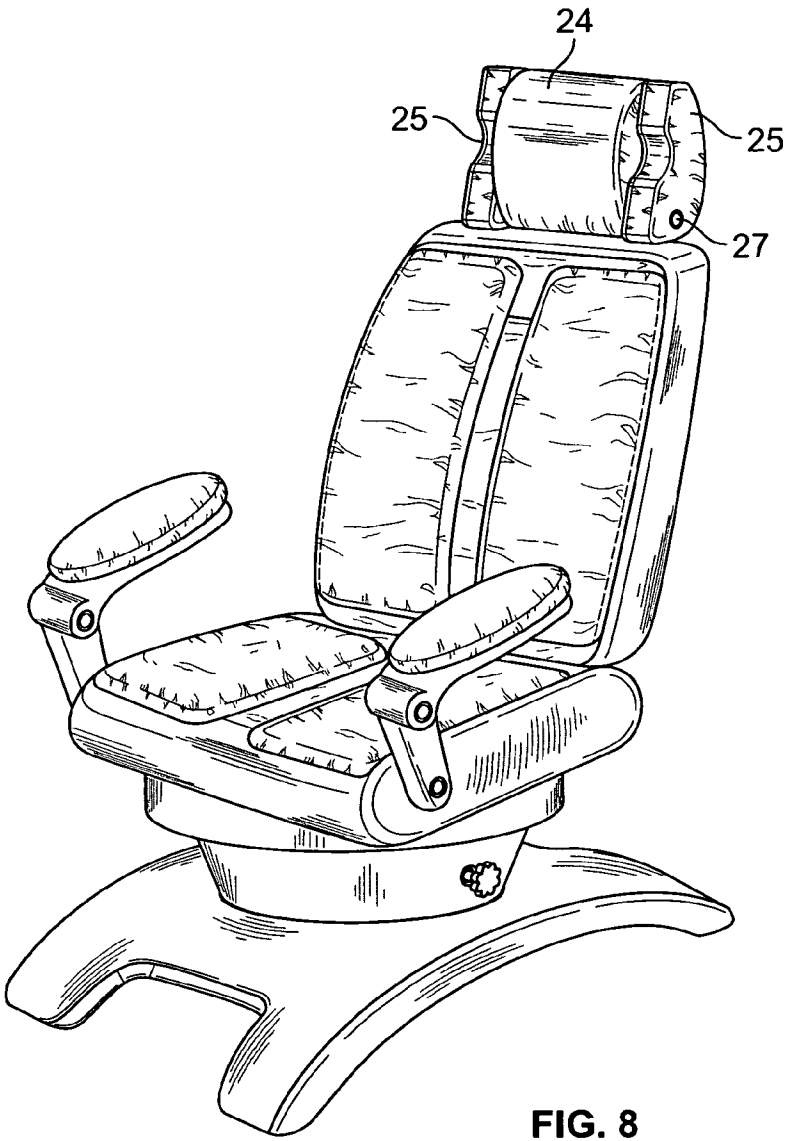
FIG. 8 is a perspective view of a multiple mode massage chair with shoulder massage elements in a chair mode.

The shoulder massage mechanism is shown in FIGS. 8, 9. A headrest 24 has a pair of shoulder massage elements 25 that fold down onto the shoulders of a user so that they come in contact with and massage the shoulders of a user. The shoulder massage elements 25 are preferably a pair and located on the left and right sides of the head of the user. The shoulder massage elements 25 preferably rotate on a pivot 27 from an upward stowed position to a downward engaged position. A user rotates the shoulder massage elements 25 into engaged position after a hard days work, or during an office break for a shoulder massage. The user can then stow the shoulder massage elements in stowed position after the shoulder massage.

The shoulder massage elements 25 have massaging mechanisms that are electrically powered. The electrical power on the shoulder massaging elements 25 receives power from the rest of the chair, which is typically plugged into household electric current. The electrical power for the massaging mechanisms drives one or more motors for the massaging mechanisms.

The shoulder massage mechanism shown in FIG. 9 depicts flip open pad configuration for back massaging which can be implemented a user at the same time the user flips down the shoulder massage elements 25. The arm rests are positioned so that the back pads can flip open for simultaneous use with shoulder massage elements 25. The arm rests can also flip out of the way to give the user more room to get a massage. The armrests, the flip pad, and shoulder massage elements 25 can optionally lock in open and closed position. In any case, after a user is done with the massage, the user can transform the chair back into an ordinary office chair that feels like an ordinary office chair and looks like an ordinary office chair.

Figure 10:
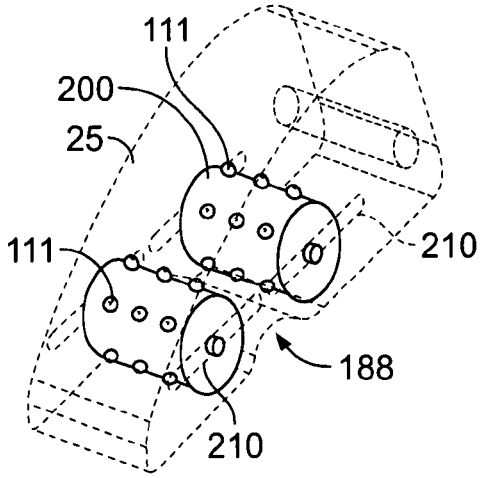
FIG. 10 is a diagram of a shoulder massage element.
Figure 11:
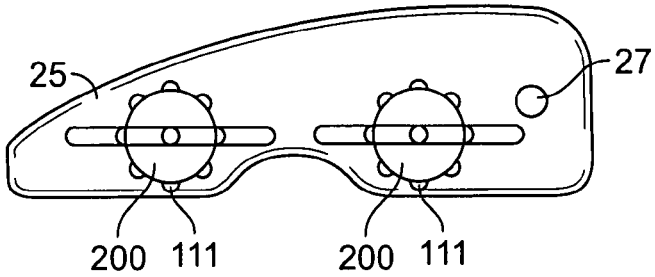
FIG. 11 is a diagram of a shoulder massage element.

FIGS. 10, 11 show the preferred embodiment of the shoulder massage elements 25 with a roller 200 in retracted position that is away from the shoulder. The operation of the shoulder massage elements 25 may include first flipping down the shoulder massage elements 25, then moving the rollers 200 along the slot 210 toward each other from the retracted position to the engaged position so that the rollers 200 contact against a shoulder. Alternatively, the rollers 200 along the slot 210 can be preset or have a predefined positioned on the slot according to a user preference, presumably dictated by shoulder size.

As seen in FIG. 10, the preferred embodiment of the shoulder massage elements 25 includes a rolling roller 200 having a plurality of protrusions 111 shaped as knobs or bumps on a cylindrical surface which is mounted in an adjustable slot 210. Although shown as a cylindrical element, the roller can be shaped with a wider middle portion which would more ergonomically conform to a user's shoulder. The drawing has been simplified for purposes of simplicity and ease of understanding. The shoulder cavity 188 fits over a shoulder snugly and allows massage of a user shoulder. Preferably, both rollers 200 can be initially adjusted forward and backward on the slot 210 and rolling in unison so that the front roller rolls counterclockwise and the back roller rolls clockwise give a rubbing up massage on the shoulder. The motion can also be reversed to provide a rubbing down massage on the shoulder. The knobs 111 can be increased in height and increased or decreased in stiffness to allow for different types of motions. Preferably, but knobs 111 have some deflection to mimic the feel of a hand massage.

FIG. 11 shows a side view of the massaging knobs 111 having a low profile. High-profile knobs can replace the low-profile knobs if necessary for more finger sensation on the shoulder. The roller should be sufficiently wide to match a typical user shoulder muscle dimension. The side view shown in FIG. 11 provides a view of the pivoting axis 27 which is preferably at a right angle to the shoulder massaging element 25. The shoulder massaging element 25 is generally formed as an armature with shoulder massaging cavity 188. FIG. 10, 11 show the rollers 200 in retracted position away from the shoulder, but during operation the rollers 200 may be biased against the shoulder along slot 210 to provide a harder massage. For a softer massage, the rollers 200 can be softly biased against the shoulder. The strength of the bias against the shoulder can be adjusted by a wide variety of mechanical means commonly known in the art such as by a spring or such as by locking the axles of the rollers 200 in position somewhere along the slot 210 with a wider distance providing a softer massage and a smaller distance providing a harder massage.

The speed of the rollers 200 can be electronically controlled or otherwise user selected using a user control which is also commonly known in the art. The rollers 200 can reciprocate in motion and direction. The rollers 200 can also include vibration elements within the rollers 200 that activate when the rolling motion is paused. The rollers can also be adjusted on the slot by a user electronic controller of the type that is commonly known in the art. Therefore, by including vibration elements within the rollers 200, the user can have the alternating experience of vibration of the shoulder and rolling of the shoulder.

Figure 12:
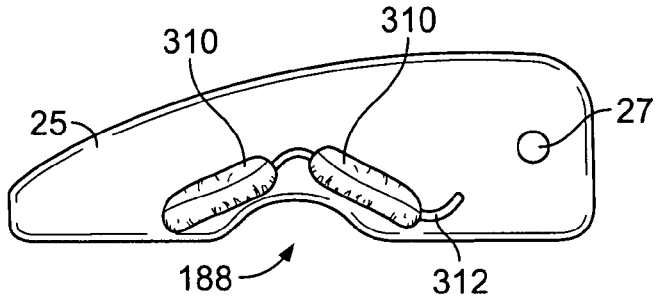
FIG. 12 is a diagram of a shoulder massage element.

In an alternate embodiment of the shoulder massaging element 25, FIG. 12 shows airbags 310. A pair of airbags can replace the rolling massage knobs 111 providing front and rear compression against the front and rear of the shoulder when inflated. Inflation tube 312 connects to an air compressor. The inflation tube 312 can pass through the pivot 27 if the pivot 27 is formed as a hollow member. The inflation tube 312 can thus be inflated by an air compressor which is located either within the shoulder massaging element 25 or outside of the shoulder massaging element 25 such as within the base of the chair or within the seat back of the chair.

FIG. 12 shows airbags 310 in inflated configuration. Typically, a shoulder would be placed within the shoulder massaging cavity 188. The airbags would then inflate against the shoulder. The airbags would then deflate after inflating so that the airbags 310 have an inflated state as shown and a deflated state. The massaging cavity 188 would contract upon inflation of the airbags 310 and press against a shoulder that is placed within a cavity 188. The shape of the cavity 188 can be shallow as shown in FIG. 12, or deeper so that the airbags press against the front and back portion of a shoulder in diametric opposition. In shallow configuration, the airbags press partially against the front and back of a shoulder, but also the top of a shoulder. Alternatively, more than two airbags can be used in a deeper shoulder massaging cavity, like four or five airbags so that the front and back of the shoulder is pressed on all sides. Also, a single airbag having multiple sections can replace the multiple airbag embodiment. Airbags need not be independently inflated, and can be in fluid connection with each other. The airbags could also be filled or partially filled with a liquid to provide superior ergonomic contour and generally allow for a different range of shape and shoulder pressing.

The shoulder massage elements 25 may include a wide variety of massaging mechanisms disposed on the shoulder facing portion of the shoulder massage elements 25. For example, the shoulder massage elements 25 can have vibrating motors that impart a vibration massage to the shoulders. Also, the shoulder massage elements 25 can further include traditional roller massage type structures such as those structures is found in U.S. Pat. No. 6,629,939 the disclosure of which is incorporated herein by reference, or in portable body massagers disclosed in U.S. Pat. No. 7,128,721 the disclosure of which is incorporated herein by reference.

The shoulder massage elements 25 may include roller heads that are similar to the back massager roller heads 60. A pair of roller heads can massage alternatively the user shoulder. Roller heads can be reciprocating, which is well known in the art and described in various patents, such as in for example U.S. Pat. No. 6,387,063 issued to Elenar, patented May 14, 2002, the disclosure of which is incorporated herein by reference. The roller heads in the Elenar reference can massage the front and rear portion of the shoulder muscles in synchronized or alternating rolling movement.

Other massaging mechanisms that can be used with the shoulder massage elements 25 also include percussive massagers commonly known in the art, such as those described in U.S. Pat. No. 6,500,135 issued to Huang, patented Dec. 31, 2002, the disclosure of which is incorporated herein by reference. The dual head percussive massager such as that shown in the Huang reference can have alternating head movement to alternatively hit the front and rear portion of the shoulder muscles.

Other massaging mechanisms that can be used with the shoulder massage elements 25 also include airbag massagers commonly known in the art. Airbag massagers are driven by an electric air pump typically located in the base of the chair 18 with an airline from the electric air pump to the airbag. The user shoulder typically fits within a cavity formed by the airbag so that inflation of the airbag and deflation of the airbag gives cyclical massage to a user shoulder. The use of an airbag as a massaging mechanism is well known in the art, and typically described in patents such as Hara in U.S. Pat. No. 4,231,355, issued on Nov. 4, 1980, the disclosure of which is incorporated herein by reference. The Hara reference has an airbag that inflates gently against a user body which is more of a passive airbag configuration. An active airbag configuration is also known in the art and has a pair of opposing airbags, in this case a forward air bag pressing against a rearward airbag in typical diametric opposition. An example of the active airbag configuration is described in U.S. Pat. No. 6,315,744 to Inaba, issued on Nov. 13, 2001, the disclosure of which is incorporated herein by reference. The Inaba reference discusses opposing airbags that press on the right and left side of a user leg. Another example of an active airbag configuration is described in U.S. Pat. No. 5,762,618 to Yamanaka patented on Jun. 9, 1998.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims. For example, the flap of the present invention may be integrated into the upholstery of a vehicle chair with a massaging option. Therefore, while the presently preferred form of the massaging chair has been shown and described, and several modifications thereof discussed, persons skilled in this art will readily appreciate that various additional changes and modifications may be made without departing from the spirit of the invention, as defined and differentiated by the following claims.

The invention claimed is:

1. A chair for use as a seat and a massager comprising:

a. a base;

b. a seat connected to the base, the seat having a seat bottom and a seatback; wherein the seatback has a front seating surface for supporting a seated user's upper torso;

c. a shoulder massaging element, pivotally mounted to a headrest, and having a shoulder massaging cavity, wherein the shoulder massage cavity is downward facing when the shoulder massaging element is in an engaged position, and wherein the shoulder massaging element also stows to a retracted position from the engaged position;

d. a massaging unit mounted on the seat back; and e. at least one cushion flap removably attached to the seat back to cover the massaging unit in a seat mode and not cover the massaging unit mode in a massaging mode.

2. The chair of claim 1, wherein the cushion flap has a hinged connection to the seatback.

3. The chair of claim 1, wherein the shoulder massaging element has a rotating roller element with protruding knobs mounted on the roller element.

4. The chair of claim 3, further comprising a second shoulder massaging element having a second shoulder massaging element and a second shoulder massaging cavity.

5. The chair of claim 1, further comprising a second shoulder massaging element;

and further comprising an air bag installed in each shoulder massaging element.

6. A chair for being interchangeably used as a seating support and a massaging platform comprising:

a. a horizontal base;

b. a seat bottom assembled to the base through an upright stand, the seat bottom having soft seating surfaces for supporting a seated user longitudinally;

c. a shoulder massaging element, and having a shoulder massaging cavity;

d. a seatback fixed to the assembly of the seat bottom and upright stand and having front seating surfaces for supporting the seated user's upper torso, wherein the shoulder massaging element is pivotally mounted to a headrest; and e. a pair of elongated cushion flaps pivotally attached to the seatback for selectively providing an extra cushion to the seated user on the respective front seating surfaces.

7. The chair of claim 6, wherein each flap has a proximal edge with its middle portion recessed and attached to the front seating surfaces so that the rest of the proximal edge of the flap is normally biased by the front seating surfaces to keep the flap flat before and after its pivotal movement into either a first inactive position away from a central area of the respective front seating surfaces but close to the periphery of the seat bottom or seatback or a second active position superimposing substantially half the central area of the seating surfaces, whereby the opposing flaps in a pair can add or subtract cushion to and from the respective front seating surfaces of the seatback in a toggle action.

8. The chair of claim 6, further comprising an internal massaging unit installed in the seatback, the massaging unit having massaging heads traveling along a track in a frame by an electric motor and transmission mechanism so that the roller movements may be delivered only through the seating surfaces to the seated user with pairs of cushion flap occupying a first inactive position.

9. The chair of claim 6, further comprising a portable electrical massaging unit mounted on the seating surfaces of the seatback, the massaging unit also having seating surfaces, vibrating pressure rollers traveling along a track in a frame by an electric motor and transmission mechanism, and the roller movements may be delivered only through the seating surfaces of the massaging unit to the seated user with pairs of cushion flap are in a first inactive position.

10. The chair of claim 6, wherein each of the flaps comprises a core padding shaped to comfortably cushion a posterior of the seated user when their distal edges opposite from a proximal edges conjoin in a second active position, two symmetrical covering sections joined along a center area in a symmetrical shape, the covering sections being folded over the core padding and glued and sewn together, and an integral flexible hinge with a pivot line retreated toward a center of the flap at the recessed middle portion of the proximal edge, the hinge being reinforced either by an extension of the core padding or an extra elastic plate mated with a portion of the core padding to maintain the hinge flexible.

11. The chair of claim 6, wherein an exterior as well as a mode of operation of the chair switch between a seating for a worker and a massaging platform with short lateral flips of the cushion flaps.

12. The chair of claim 6, wherein an exterior as well as a mode of operation of the chair switch between a seating for a vehicle passenger and a massaging platform with short lateral flips of the cushion flaps.

13. A massage chair for being interchangeably used as a massage chair comprising:

a base;

a seat bottom assembled to the base through a telescopic upright stand for a height adjustment from the base, the seat bottom having soft seating surfaces for supporting a seated user longitudinally;

two shoulder massaging elements, and each having a shoulder massaging cavity, wherein the two shoulder massage cavities are downward facing when the two shoulder massaging elements are in an engaged position, and wherein the two shoulder massaging elements also stow to a retracted position from the engaged position;

a seatback fixed to an assembly of the seat bottom and upright stand and having front seating surfaces for supporting the seated user's upper torso, wherein the shoulder massaging element is pivotally mounted to a headrest.

14. The chair of claim 13, further comprising a roller having knobs installed in each of the two shoulder massaging elements.

15. The chair of claim 13, further comprising an air bag installed in each of the two shoulder massaging elements.

16. The chair of claim 13, wherein each of the flaps comprises a core padding shaped to comfortably cushion the posterior of the seated user when their distal edges opposite from the proximal edges conjoin in the second active position, two identical covering sections joined along a center area in a symmetrical shape, the covering sections being folded over the core padding and glued and sewn together, and an integral flexible hinge with a pivot line retreated toward the center of the flap at the recessed middle portion of the proximal edge, the hinge being reinforced either by an extension of the core padding or an extra elastic plate mated with a portion of the core padding to maintain the hinge flexible.

17. The chair of claim 16, further comprising a seatback fixed to the assembly of the seat bottom and upright stand and having front seating surfaces for supporting the seated user's upper torso; and a pair of elongated cushion flaps pivotally attached to the seatback for selectively providing an extra cushion for the seated user.

* * * * *